US008012601B2

(12) United States Patent
Kruger et al.

(10) Patent No.: US 8,012,601 B2
(45) Date of Patent: Sep. 6, 2011

(54) COLD GAS SPRAYING METHOD

(75) Inventors: Ursus Kruger, Berlin (DE); Raymond Ullrich, Schonwalde (DE)

(73) Assignee: Siemens Aktiengesellschaft, Munich (DE)

( * ) Notice: Subject to any disclaimer, the term of this patent is extended or adjusted under 35 U.S.C. 154(b) by 1041 days.

(21) Appl. No.: 11/721,200

(22) PCT Filed: Dec. 6, 2005

(86) PCT No.: PCT/EP2005/056521

§ 371 (c)(1),
(2), (4) Date: Jun. 8, 2007

(87) PCT Pub. No.: WO2006/061384

PCT Pub. Date: Jun. 15, 2006

(65) Prior Publication Data

US 2009/0239754 A1 Sep. 24, 2009

(30) Foreign Application Priority Data

Dec. 8, 2004 (DE) ..... 10 2004 059 716

(51) Int. Cl.

| | |
|---|---|
| ***B05D 1/02*** | (2006.01) |
| ***B05D 5/00*** | (2006.01) |
| ***B05D 7/00*** | (2006.01) |
| ***B32B 5/16*** | (2006.01) |
| ***B32B 15/16*** | (2006.01) |

(52) U.S. Cl. ..... 428/688; 428/700; 428/701; 428/336; 428/328; 428/323; 427/421.1; 427/446; 427/190; 427/201; 427/212; 252/500; 505/470; 505/473; 505/477

(58) Field of Classification Search ..... 252/500, 252/514, 518.1, 519.1; 428/697–702, 323, 428/328, 402, 432, 469, 688–689; 427/446, 427/453, 455, 62, 74, 126.1, 126.3, 190, 427/201, 421.1, 427.1; 505/473, 477; 136/244, 136/256, 260–265

See application file for complete search history.

(56) References Cited

U.S. PATENT DOCUMENTS 5,635,730 A * 6/1997 Sakakibara ..... 257/34
5,646,094 A 7/1997 Tallon et al.

(Continued)

FOREIGN PATENT DOCUMENTS

DE 3806177 9/1989

(Continued)

OTHER PUBLICATIONS

Lima et al, "Microstructural characteristics of cold-sprayed nanostructured WC-Co coatings," Thin Solid Films, 2002, 416, 129-135.*

Wolfgang Bergmann, "Werkstofftechnick Teil 1: Grudlagen", 2. Auflage, Carl Hanser Verlag, Seiten 53-55, 1999.

Homepage von Kurt Helming, "Texture and Anisotropie kristalliner Materialien", www.texture.de, 2000.

(Continued)

*Primary Examiner* — Stanley Silverman
*Assistant Examiner* — Kallambella Vijayakumar
(74) *Attorney, Agent, or Firm* — Young & Thompson

(57) ABSTRACT

In a cold gas spraying method, a gas jet (15) into which particles (19) are introduced is generated with the aid of a cold gas spray gun (20). The kinetic energy of the particles (19) results in a layer being formed on a substrate (13). The substrate is provided with a structured texture (24) which is transferred to the layer (20) that is formed. The method makes it advantageously possible to produce a high-temperature superconducting layer on the substrate (13) by selecting an appropriate particle (19) composition. The process can be additionally supported using a heating device (25) in a subsequent thermal treatment step.

21 Claims, 1 Drawing Sheet

U.S. PATENT DOCUMENTS

| | | | | |
|---|---|---|---|---|
| 6,620,645 | B2 * | 9/2003 | Chandra et al. | 438/98 |
| 7,153,567 | B1 * | 12/2006 | Akedo et al. | 428/323 |
| 2002/0056473 | A1 | 5/2002 | Chandra et al. | |
| 2004/0026030 | A1 * | 2/2004 | Hatono et al. | 156/279 |
| 2004/0216813 | A1 * | 11/2004 | Buergel et al. | 148/537 |

FOREIGN PATENT DOCUMENTS

| | | | |
|---|---|---|---|
| DE | 3806178 | | 9/1989 |
| EP | 0456600 | | 11/1991 |
| WO | 8908332 | | 9/1989 |
| WO | WO 0127348 | * | 4/2001 |
| WO | 2004044672 | | 5/2004 |

OTHER PUBLICATIONS

Lima R.S. et al. "Microstructural characteristics of cold-sprayed nanostructured WC-Co coatings" Preparation and Characterization, Elsevier Sequoia NL, Db. 416, Nr. 1-2,2. (Sep. 2, 2002, Seiten 129-135.

* cited by examiner

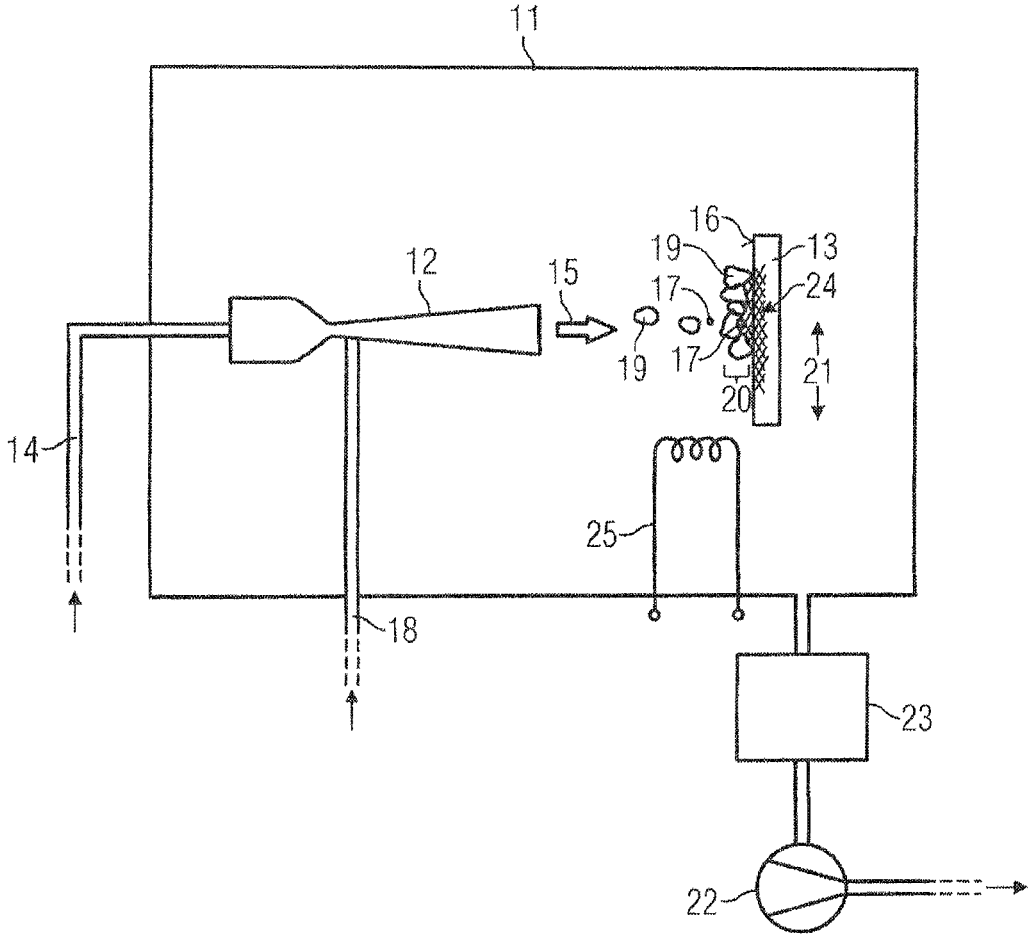
11
12
13
14
15
16
17
17
18
19
19
20
21
22
23
24
25

COLD GAS SPRAYING METHOD

The invention relates to a cold gas spraying method, in which particles for producing a layer on a substrate are accelerated in the unmelted state by means of a gas jet toward the surface of the substrate, where they adhere by conversion of their kinetic energy.

Such a method is described, for example, in US 2004/0037954 A1. The device needed for operating the method comprises a vacuum chamber, in which a substrate can be placed in front of a so-called cold gas spray gun. In order to carry out the coating, the vacuum chamber is evacuated and a gas jet, into which particles for coating the workpiece are fed, is generated by means of the cold gas spray gun. They are strongly accelerated by the cold gas jet, so that adhesion of the particles on the surface of the substrate to be coated is achieved by converting the kinetic energy of the particles. The particles may additionally be heated, in which case their heating is limited so that the melting temperature of the particles is not reached (this situation gives rise to the name cold gas spraying).

It is an object of the invention to provide ways of improving the quality of cold gas spray coatings.

BRIEF DESCRIPTION OF THE DRAWING

FIG. 1 shows a cold gas spraying installation for producing a structured layer over a substrate.

This object is achieved according to the invention in that the substrate comprises a structured texture and this is imparted to the adhering particles. The layer formed by the particles contained in the cold gas jet consequently has a structured texture, which is dictated by the structure of the substrate on which the layer grows. Although the textured substrate is no longer available for the layer formation as the layer buildup progresses, the particles already applied nevertheless have the desired structured texture so that they can be used as a substrate for further incident particles, to which the desired structured texture is in turn imparted.

Indeed, it has surprisingly been found that the structured texture of the substrate can also be imparted to the particles involved in the layer formation by a cold gas spraying method, even though by virtue of the method they are not melted. This can be explained in that the pronounced kinetic energy of the particles, which is sufficient for the particles to adhere on the substrate, is also responsible for a structural change which forces adoption of the structured texture of the substrate. Here, the energy contribution introduced into the cold gas jet (primarily the kinetic energy) must be dimensioned so that it is sufficient to cause the structural modification. In this way, the layer to be produced can be provided with particular features which lead to an improvement in quality regarding particular desired properties.

According to one refinement of the invention, the particles contain the mechanical constituents of a solar cell material, in particular CIS, and the substrate has a structured texture which corresponds to that of the solar cell to be produced. With this method, therefore, solar cells can be produced in so-called thin film technique in which the corresponding substrate is coated with the solar cell material. CIS is copper indium diselenite (hence the term CIS), this compound being one of the most promising candidates for achieving comparatively high efficiencies. If the solar cell applied in thin film technology is additionally provided with a structured texture, which also makes it possible to produce a technical single crystal, then the efficiency of the thin film solar cell can advantageously be increased further.

According to an alternative configuration of the invention, the particles contain the chemical constituents of a high-temperature superconductor (hereafter abbreviated to HTSC) and the substrate has a structured texture which corresponds to that of the HTSC. Indeed, it has been found that even the complex lattice structure of HTSCs can be produced by means of cold gas spraying so long as the substrate dictates this structured texture. Surprisingly, this texture can be transferred onto the coating being formed even if the particles are not melted during this coating process. This can be explained in that the processes taking place owing to the kinetic energy of the particles also lead to the formation of a structured texture suitable for HTSCs, if this is dictated by the structure. In this way semifinished HTSC products, for example strip conductors, can advantageously be produced in an inexpensive way and the method of cold gas spraying is made available for superconducting applications.

According to one configuration of the invention, the particles are formed from intermediate products for the HTSC or the solar cell material. When the particles strike the substrate, these intermediate products then lead to a layer composition of the coating being formed which comprises the composition required for forming the HTSC. In this way, it is advantageously possible to produce the particles as intermediate products or precursors. Fabrication methods which are as simple as possible may advantageously be selected for producing the intermediate products, which finally makes the production process of the layer more economical. Various layer compositions can furthermore be achieved by suitable mixing of the intermediate products, without special particles having to be prepared for each layer composition.

According to another configuration of the invention a reactive gas, in particular oxygen, which becomes incorporated into the layer, is added to the gas jet. The variety of layers producible can thereby advantageously be increased further, since the possibility of supplying a reactive gas advantageously provides an extra parameter for controlling the process taking place. In particular, the intermediate products being used do not need to contain the full complement of the relevant chemical element which is made available by the reactive gas. This means, for example, that the intermediate products do not need to contain any metal oxides if it is more economical to produce the elementary particles and the oxygen is added as a reactive gas.

It is particularly advantageous for nanoparticles to be used as particles. These, especially when the particles are formed from intermediate products, ensure good mixing of the particles incorporated into the layer being formed, so that the diffusion lengths of the atoms needed in order to form the desired composition of the HTSC advantageously become small.

Said diffusion process can advantageously be assisted if a heat treatment of the coated substrate is carried out after having applied the particles. If the structured texture of the substrate has not yet fully been transferred to the coating, this may be completed by diffusion processes which are brought about by the heat treatment. The quality of the HTSC layer can thereby advantageously be further improved.

Exemplary embodiments of the composition of particles usable in the cold gas spraying method will be given below with reference to the example of the HTSC YBCO ($YBa_2Cu_3O_7$).

For direct coating with a $YBa_2Cu_3O_7$, $YBa_2Cu_3O_7$ powder formed by nanoparticles may preferably be sprayed directly onto the textured substrate. At the latest in a subsequent heat treatment step, which may optionally be combined with supplying oxygen, the desired superconducting structured texture is now formed.

If the coating is to be carried out with intermediate products (precursors), then for example mixing of $YBa_2Cu_3O_7$ or even CuO powder may take place by means of the cold gas spraying method. As an alternative, a suitable mixture of $Y_2O_3$-g $BaCO_3$ and Cu or even CuO powder may also be used. Lastly, a suitable mixture of particles of Y, Ba or Cu salts (for example oxides, carbonates, nitrates or fluorides) may also be used.

Suitable mixtures of said intermediate products respectively have a composition such that the stoichiometric composition of $YBa_2Cu_3O_7$ is achieved in the layer formed from the intermediate products. Oxygen may respectively be supplied as a reactive gas during the cold gas spraying, so that these components are incorporated into the layer. A subsequent reaction step or heat treatment step may furthermore be carried out in order to assist the diffusion of the constituents of the HTSC, the desired structured texture being formed at the latest during this treatment step. Oxygen may also be supplied during the heat treatment step, which allows later incorporation of oxygen atoms into the HTSC layer.

An exemplary embodiment of the method will furthermore be described with the aid of the single FIGURE. A device for cold gas spraying is represented. It comprises a vacuum container 11, in which a cold gas spray gun 12 on the one hand and a substrate 13 on the other hand are arranged (fastening not represented in detail). Through a first line 14, a process gas can be supplied to the cold gas spray gun 12. This, as indicated by the contour, comprises a Laval nozzle through which the process gas is expanded and accelerated in the form of a gas jet (arrow 15) toward a surface 16 of the substrate 13. The process gas may contain oxygen 17 as a reactive gas. The process gas may furthermore be heated (in a way which is not shown), so that a required temperature is set up in the vacuum container 12.

Through a second line 18, preferably nanoparticulately formed particles 19 can be supplied to the cold gas spray gun 12, which are accelerated in the gas jet and strike the surface 16. The kinetic energy of the particles causes them to adhere on the surface 16, the oxygen 17 also being incorporated into the layer 20 which is formed. In order to form the layer, the substrate 13 may be moved to and fro in front of the cold gas spray gun 12 in the direction of the double arrow 21. During this coating process, the vacuum in the vacuum container 11 is constantly maintained by a vacuum pump 22, the process gas being fed through a filter 23 before it passes through the vacuum pump 22, in order to filter out particles which have not bound to the surface 16 when striking it.

The substrate has a structured texture 24. As schematically represented, the structured texture 24 is partially transferred to the particles 19 when they strike the surface 16, the property of the layer 20 of being high-temperature superconductive thereby being produced. The structural constituents needed for forming this structural texture are ensured by suitably mixing the particles of intermediate products or incorporating the oxygen 17. A heat treatment step, which is carried out by means of an indicated heater 25, is performed in the vacuum container 11 after the method step represented in order to completely form the structured texture 24.

The invention claimed is:

1. A cold gas spraying method for producing a layer on a substrate, comprising:

accelerating particles in an unmelted state by means of a gas jet toward a surface of the substrate, the surface having a structured texture; and adhering the particles to the substrate by conversion of their kinetic energy, forming the layer, wherein the structured texture of the surface is imparted to the adhering particles.

2. The method as claimed in claim 1, wherein a reactive gas is added to the gas jet and the reactive gas is incorporated into the layer.

3. The method as claimed in claim 1, wherein the particles are nanoparticles.

4. The method as claimed in claim 1, wherein a heat treatment of the coated substrate is carried out after having applied the particles.

5. The method as claimed in claim 2, wherein the particles are nanoparticles.

6. The method as claimed in claim 2, wherein a heat treatment of the coated substrate is carried out after having applied the particles.

7. The method as claimed in claim 3, wherein a heat treatment of the coated substrate is carried out after having applied the particles.

8. The method as claimed in claim 2, wherein the reactive gas is oxygen.

9. The method of claim 1, wherein the particles contain the chemical constituents of a solar cell material and the substrate has a structured texture which corresponds to the structured texture of a solar cell to be produced.

10. A cold gas spraying method for producing a layer on a substrate, comprising:

accelerating particles in an unmelted state by means of a gas jet toward a surface of the substrate, the surface having a structured texture; and adhering the particles to the substrate by conversion of their kinetic energy, forming the layer, wherein the particles contain the chemical constituents of a solar cell material and the substrate has a structured texture which corresponds to the structured texture of the solar cell to be produced.

11. The method as claimed in claim 10, wherein the particles are formed from intermediate products for the solar cell material.

12. The method as claimed in claim 11, wherein a reactive gas is added to the gas jet and the reactive gas is incorporated into the layer.

13. The method as claimed in claim 10, wherein the particles are nanoparticles.

14. The method as claimed in claim 11, wherein the particles are nanoparticles.

15. The method as claimed in claim 10, wherein a heat treatment of the coated substrate is carried out after having applied the particles.

16. The method as claimed in claim 11, wherein a heat treatment of the coated substrate is carried out after having applied the particles.

17. The method as claimed in claim 10, wherein the chemical constituents of a solar cell material is copper indium diselenite (CIS).

18. A cold gas spraying method for producing a layer on a substrate, comprising:

accelerating particles in an unmelted state by means of a gas jet toward a surface of the substrate, the surface having a structured texture; and adhering the particles to the substrate by conversion of their kinetic energy, forming the layer, wherein the particles contain the chemical constituents of a high-temperature superconductor (HTSC) and the substrate has a structured texture which corresponds to the structured texture of the HTSC.

19. The method as claimed in claim 18, wherein the particles are formed from intermediate products for the HTSC.

20. The method as claimed in claim 18, wherein the particles are nanoparticles.

21. The method as claimed in claim 18, wherein a heat treatment of the coated substrate is carried out after having applied the particles.

* * * * *